United States Patent [19]

Anderson

[11] 4,268,023

[45] May 19, 1981

[54] DOCUMENT-FEEDING APPARATUS

[75] Inventor: Carl P. Anderson, Menlo Park, Calif.

[73] Assignee: Ricoh Company, Ltd., Tokyo, Japan

[21] Appl. No.: 67,689

[22] Filed: Aug. 20, 1979

[51] Int. Cl.[3] ..... B65H 3/12

[52] U.S. Cl. ..... 271/94; 271/99; 271/106

[58] Field of Search ..... 271/94, 96, 99, 106, 271/108, 11

[56] References Cited

U.S. PATENT DOCUMENTS

| | | | |
|---|---|---|---|
| 2,813,612 | 11/1957 | Berglund | 271/11 X |
| 3,331,602 | 7/1967 | Cox | 271/99 X |
| 3,981,494 | 9/1976 | Presteguard | 271/99 X |

*Primary Examiner*—Richard A. Schacher
*Attorney, Agent, or Firm*—Claude A. S. Hamrick

[57] ABSTRACT

A document-feeding apparatus including feed rollers 90, pressure roller 50, a planar tray 16 for receiving a stack of sheet material and having one end portion 94 thereof deformed arcuately away from the main plane of the tray, the arcuate segment 94 being provided with openings 98 through which a sheet separating vacuum may be drawn, and longitudinally extending slots 96 through which the paper-engaging surfaces of the continuously running feed rollers 90 extend, an oscillatory vacuum pumping mechanism 92 for periodically drawing air through the vacuum openings so as to deflect the overlying end portion of the bottom sheet of the stack of material downwardly into engagement with the feed rollers 90 after which the pressure rollers 50 are moved into engagement with the upper surface of the deflected bottom sheet to hold it against the feed rollers 92 as it is driven thereby toward a pair of exit rollers 84 and 86 which thereafter discharge the sheet from the device.

11 Claims, 5 Drawing Figures

DOCUMENT-FEEDING APPARATUS

BACKGROUND OF THE INVENTION

1. Field of the Invention

The present invention relates generally to document-feeding apparatus for printers and the like, and more particularly to an improved document feeder using a pressure reduction principle for sheet take-off.

2. Description of the Prior Art

Although vacuum take-off devices for printing and duplicating machines are known in the prior art, such devices have typically utilized complicated mechanical valving in combination with suction rollers, shuttles or other devices which are not only expensive to manufacture but are difficult to maintain. Apparatus such as those disclosed in the United States patents of Hans-Joachim Jahme, U.S. Pat. Nos. 3,861,667 and 3,921,523, overcome some of the problems of the prior art, but require that the paper be folded over nearly 180° as it raps around a suction roller and is discharged. This, of course, gives rise to a number or problems having to do with suction regulation, stiffness of paper, etc.

SUMMARY OF THE INVENTION

It is therefore a primary object of the present invention to provide an improved apparatus for individually feeding sheet material from a stack without requiring the use of complicated suction rollers, valving or other sophisticated pneumatic means.

Briefly, a preferred embodiment of the present invention includes a planar tray for receiving a stack of sheet material. One end of the tray is deformed arcuately away from the plane of the tray, and the arcuate segment is provided with openings through which a sheet separating vacuum is drawn, and longitudinally extending slots through which the paper-engaging surfaces of continuously running feed rollers extend. An oscillatory vacuum pumping mechanism is also provided for periodically drawing air through the vacuum openings so as to deflect the overlying end portion of the bottom sheet of the stack downwardly into engagement with the feed rollers after which pressure rollers are moved into engagement with the upper surface of the deflected bottom sheet to hold it against the feed rollers as it is driven thereby toward a pair of exit rollers which thereafter discharge the sheet from the device.

Among the several advantages of the present invention are its mechanical simplicity, its reliability of operation, the fact that the entire device is driven by single electric motor, and that the device does not require the provision of an external vacuum source.

These and other objects and advantages of the present invention will no doubt become apparent to those of ordinary skill in the art after having read the following detailed description of the preferred embodiment which is illustrated in several figures of the drawing.

IN THE DRAWING

DETAILED DESCRIPTION OF THE PREFERRED EMBODIMENT

Figure 1:
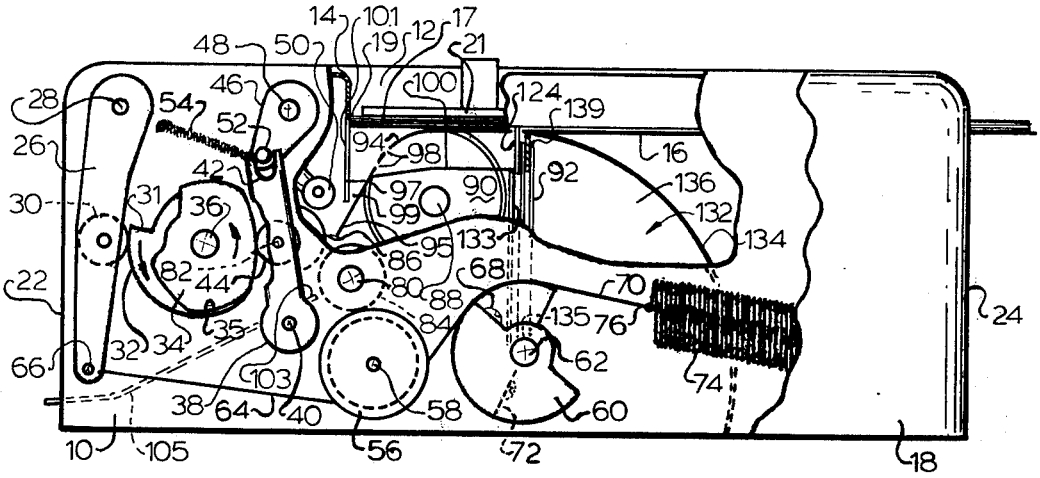
FIG. 1 is a partially broken side elevation showing a document-feeding device in accordance with the present invention.
Figure 2:
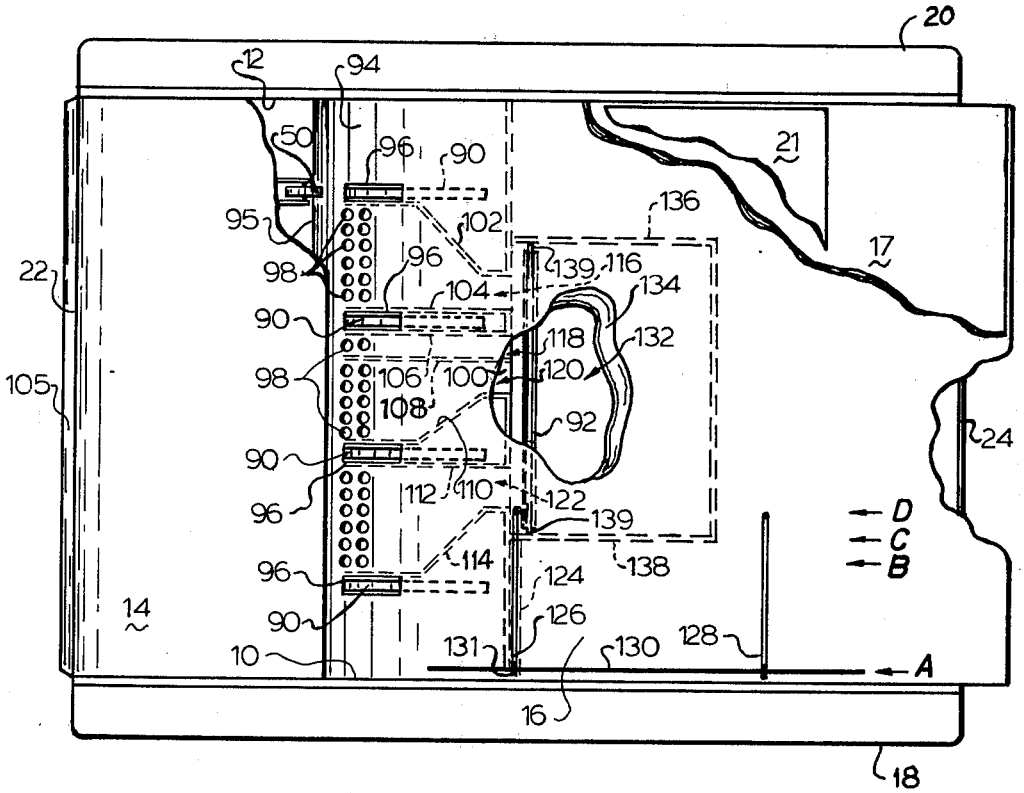
FIG. 2 is a partially broken top view of the document feeding device.

Referring now to FIGS. 1 and 2 of the drawing which are respectively partially broken side and top views illustrating an embodiment of the present invention, it will be noted that the operative mechanisms of the device are affixed to a chassis including a pair of side plates 10 and 12 and are concealed within the device by a top cover plate 14, a tray 16 for supporting a stack 17 of paper or other thin sheet material, a pair of side covers 18 and 20, and a pair of end panels 22 and 24.

Disposed externally of side plate 10 is a vane-restoring cam follower 26 pivotally carried by a support shaft 28 and including a cam-following roller 30, a vane-restoring cam 32, which is engaged by roller 30, and a pressure roller actuating cam 34, both of which are carried by a shaft 36, and a cam follower 38 pivotally secured to a shaft 40 at its lower end and having a pin-receiving slot 42 formed in its upper end. Note that follower 38 also carries a roller 44 which engages cam 34. A crank arm 46 is secured to a shaft 48 which carries four pressure rollers 50. Crank arm 46 includes a pin 52 which mates with slot 42 and is attached to one end of a return spring 54, the other end of which is attached to plate 10.

An idler pulley 56 is journalled to plate 10 at 58 and a cable-supporting pulley device 60 is affixed to a vane shaft 62.

One end of a cable 64 is attached to cam follower 26 at 66 and the other end is attached to pulley 60 at 68. A cable 70 has one end attached to pulley 60 at 72 and its other end attached to a spring 74 at 76. The end (not shown) of return spring 74 is attached to plate 10. In addition to pressure roller support shaft 48, a pair of shafts 80 and 82 which carry exit rollers 84 and 86 respectively, a shaft 88 which carries four initial feed rollers 90, and the shaft 62 which carries the oscillating vane 92, all extend across the device and are journalled to 22 10 and 12.

As illustrated, a portion 94 of document tray 16 is curved downwardly with a radius of curvature approximately equal to the radius of feed rollers 90 and has slots 96 provided therein (FIG. 2) through which a portion of the drive surfaces of rollers 90 extend. A plurality of circular openings 98 are also formed in the lower part of portion 94 between the several openings 96 to provide inlet openings that will be further described below.

As viewed in FIG. 1, the left-most extremity 95 of tray 16 extends downwardly to a position approximately tangent to the point of mutual engagement between rollers 84 and 86. Note also that the lower extremity 97 of cover plate 14 extends downwardly toward the end portion of tray 16 and cooperates therewith to define a discharge passageway 99 through which sheets removed from the stack 17. Although not clearly shown in the drawing, four vertically-extending slots 101 are formed in cover extremity 97 to provide clearance for the pressure rollers 50 as they move toward engagement with rollers 90 at the lower ends of slots 96 (FIG. 2). These slots 101 extend upwardly to points slightly higher than the top of the bottom sheet so as to provide passages through which air may flow into the space above the sheet being removed thereby preventing pull-down of more than one sheet at a time. Disposed immediately below the rollers 84 and 86 is the upper end 103 of an exit chute 105, the width of which is equal to the spacing between side walls 10 and 12 and the length of which is long enough to extend out of the end panel 22.

Disposed beneath tray portion 94 is a plate 100 which forms the bottom wall of several air passages further defined by vertical separator walls 102, 104, 106, 108, 110, 112 and 114. More specifically, the air passages begin at the openings 98 and end at four discharge ports 116, 118, 120 and 122. An air control slide bar or gate 124 may also be provided as indicated for allowing the air passages 116, 118, 120, and 122 to be selectively closed to accommodate different widths of paper. Although numerous methods of facilitating closure of the gate 124 may be used, one way is to cut a pair of slots 126 and 128 in the tray 16 to provide guides for a movable side rail 130 which is attached to gate 124 at 131. Using this technique, when a stack of paper is disposed on tray 16 and positioned against the inside surface of wall 12, by moving rail 130 into engagement with the opposite edge of the stack, gate 124 will automatically be moved into position to close the appropriate air passages. By way of example, four possible paper width settings might be indicated by the arrows A-D.

Disposed immediately beneath the mid-length portion of tray 16 is a pump chamber 132 formed by an aft wall 133, an arcuate upper and force wall segment 134, and a pair of side walls 136 and 138. Positioned within chamber 132 with one edge attached to shaft 62 is the oscillating vane 92. Note that edge seals 139 are provided to sealingly engage walls 134, 136 and 138. The lower edge of wall 133 sealingly engages shaft 62 at 135.

Figure 3:
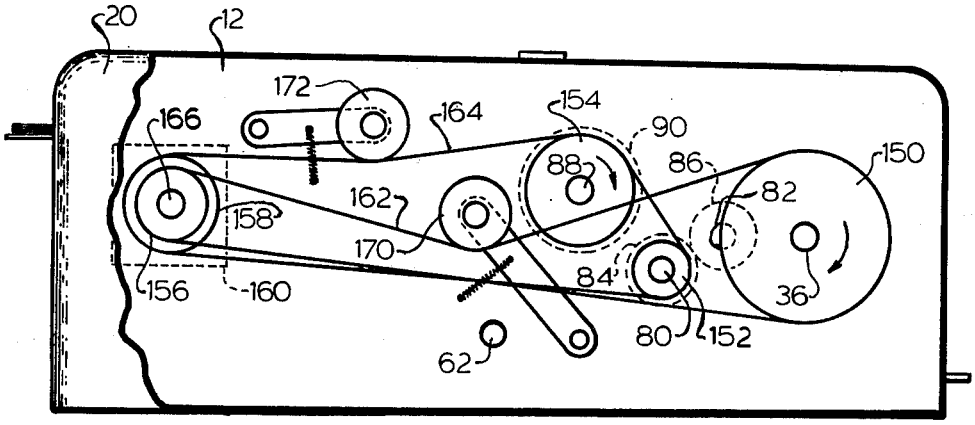
FIG. 3 is a partially broken opposite side view schematically showing the drive train of the document-feeding device.

Turning now to FIG. 3 of the drawing which is a partially broken view of the side opposite that illustrated in FIG. 1, it will be noted that affixed to the shafts 36, 80 and 88 are pulleys 150, 152, and 154, respectively. Pulley 150 is coupled to a drive pulley 156 by means of a suitable drive belt or chain 162. Similarly, pulleys 152 and 154 are coupled to a drive pulley 158 by a suitable drive belt or chain 164. A motor 160 is mounted on the inside of side plate 12 and is connected to the pulleys 156 and 158 by means of a drive shaft 166 that extends through side wall 12. Proper tension is maintained in the chains 162 and 164 by means of spring-loaded idler pulleys 170 and 172, respectively. It will thus be appreciated that motor 160 simultaneously drives the cams 32 and 34, shown FIG. 1 the exit roller 84, and the feed rollers 90. Roller 86 is driven by its engagement with roller 84, and the surface of at least one of the rollers 84 and 86 is typically covered with rubber or other resilient material so as to effect good frictional drive between the two rollers as well as the sheet to be driven therebetween.

Figure 4:
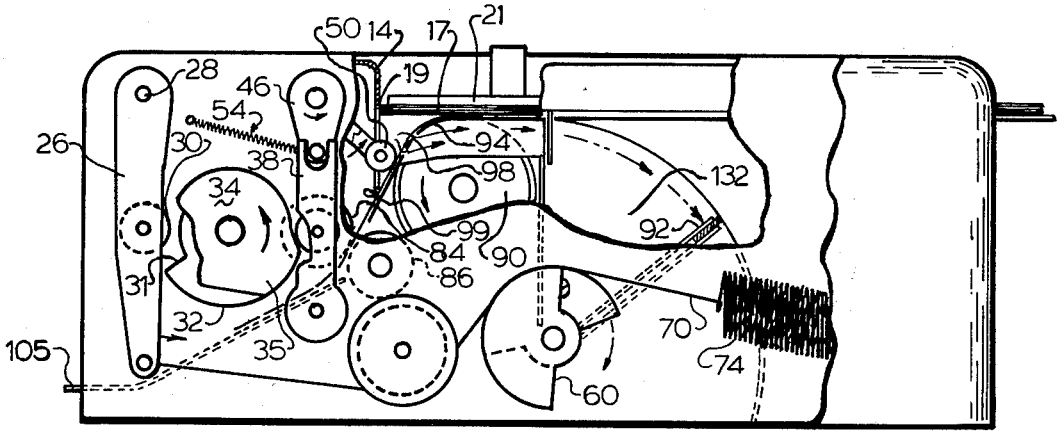
FIG. 4 is a partially broken side view illustrating operation of the document-feeding device.
Figure 5:
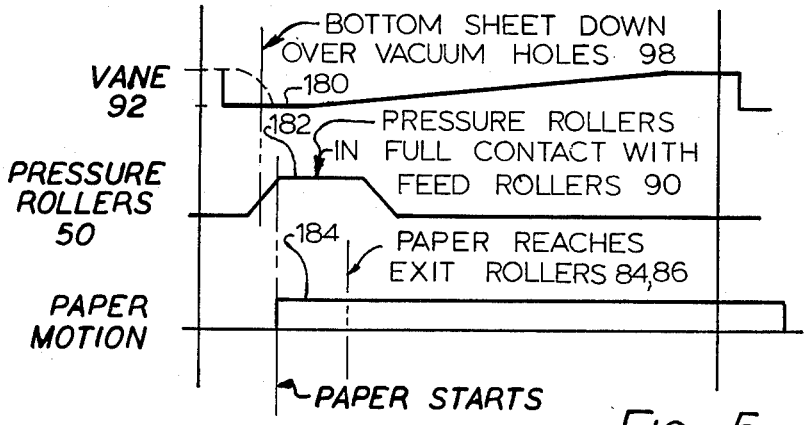
FIG. 5 is a timing diagram illustrating operation of the document-feeding device.

Referring additionally to FIGS. 4 and 5, a stack of several sheets of paper 17 is initially placed on tray 16 with their edges abutting the cover 14 at 19, and an appropriate hold-down plate 21 is placed thereon to hold the several sheets against the flat portion of the tray. The motor 160 is then started so as to cause cams 32 and 34, rollers 84 and 86, and rollers 90 to begin rotating. As cam 32 rotates in the counterclockwise direction from the position indicated in FIG. 1 to the position indicated in FIG. 4, cam-following roller 30 with roll off of the cam edge 31 causing the arm 26 to rotate about its pivot shaft 28 under the influence of spring 74 and thereby allow spring 74 (via cable 70 and pulley 60) to rotate vane 92 in the clockwise direction thereby momentarily reducing the pressure within the portion of chamber 132 between the aft wall 133 and the rotating vane 92. As this occurs, the lower pressure in chamber 132 will cause air to rush thereinto via one or more of the passageways 116–122 and the inlet openings 98, and the resulting momentary reduction of pressure beneath the unsupported end of the lower sheet in the stack 17 will cause it to be deflected downwardly over the curved portion 94.

At the same time cam 34 is also rotating in the counterclockwise direction and its eccentric lobe 35 causes follower arm 38 to drive crank arm 46 counter-clockwise, which in turn drives pressure rollers 50 into engagement with the top surface of the sheet pulled down over the openings 98 thereby sandwiching the sheet between them and the rollers 90. The resulting frictional engagement surface of the turning rollers 90 and the bottom of the sheet of paper causes the sheet to be driven downwardly through the passageway 99 and between rollers 84 and 86 which cause it to exit the device by means of the chute 105.

As the motor continues to drive the cams 32 and 34, the follower arm 26 will be rotated back in the clockwise direction causing vane 92 to rotate counter-clockwise back into the starting position illustrated in FIG. 1. At the same time, cam 34 will allow spring 54 to retract the pressure rollers 50 into the position illustrated in FIG. 1. As the cams continue to rotate, the above-described cycle will be repeated and a second sheet will be drawn from the bottom of stack 17 and fed out of the device via chute 105, etc., until the device is either stopped or all of the sheet material has been removed from the tray 16.

The operation is graphically illustrated in FIG. 5 wherein the curve 180 illustrates motion of vane 92, the curve 182 illustrates motion of rollers 50, and the curve 184 illustrates the motion of a sheet of material. It will be appreciated that insofar as curve 180 is concerned, a decreasing amplitude indicates vane rotation in the clockwise direction (as viewed in FIG. 1) and an increasing amplitude indicates vane rotation in the counterclockwise direction. With regard to curve 182, an increasing amplitude represents counterclockwise (extending) motion of the arms carrying rollers 50 and a decreasing amplitude represents clockwise (retracting) motion thereof. The curve 184 indicates that once the sheet of paper has been sandwiched between pressure rollers 50 and feed rollers 90, it is caused to very quickly accelerate to exit speed and continue at that speed until discharged out of chute 105.

Although the present invention has been described above with relation to a single preferred embodiment using certain mechanical drive and actuation techniques, it is contemplated that upon reading such disclosure one skilled in the art will recognize that since the device does not depend upon gravity or any other outside force to bow the adjacent sheet around the tray portion 94, by suitably spring-loading the hold-down plate or its functional equivalent, the device could be used in an "on-end" configuration or even in an inverted configuration. Furthermore, it is contemplated that numerous substitutions, alterations and/or modifications of the mechanical parts might be made to accommodate particular applications. It is therefore intended that the appended claims be interpreted as covering all such alterations and modifications as fall within the true spirit and scope of the invention.

What is claimed is:

1. A sheet-feeding device comprising:

means forming a document tray having a generally planar portion and a portion deformed to extend away from the plane of the planar portion, said tray means being adapted to supportively engage a stack of sheet material such that one end portion thereof extends beyond said planar portion to overlie said deformed portion, said deformed portion having at least one longitudinally-extending slot and a plurality of inlet openings formed therein;

pump means including walls forming a chamber and a vane disposed within said chamber, said vane having edges which sealingly engage the walls of said chamber, such that when said vane is actuated in one direction it sweeps through said chamber momentarily reducing the pressure therein so as to draw air through said inlet openings to momentarily reduce the pressure in the space between said deformed portion and the end portion of the facing sheet of material, the reduction of pressure being sufficient to cause the said end portion of the facing sheet to be bowed over said deformed portion;

document feed means disposed to extend through said longitudinally-extending slot;

presser means for causing the bowed sheet portion to be frictionally engaged by said feed means so as to withdraw the sheet from said stack of material; and drive means for driving said feed means, said pump means, and said presser means in cyclic fashion so that each sheet in said stack is serially removed therefrom and discharged from said device.

2. A sheet-feeding device as recited in claim 1 wherein said pump means includes an arcuate chamber and a vane pivotally disposed therein such that when said vane is rotated in one direction about its pivot axis it causes air to be drawn through said inlet openings.

3. A sheet-feeding device as recited in claim 2 wherein said feed means includes a plurality of frictional feed rollers disposed to extend through said slots to engage the facing surface of a sheet bowed over said deformed portion.

4. A sheet-feeding device as recited in claim 3 wherein said presser means includes a plurality of presser rollers which are moved from a retracted position to an extended position to press a bowed sheet of material into driven engagement with said feed rollers.

5. A sheet-feeding device as recited in claim 4 and further comprising first cam means driven by said drive means and operative to cyclically move said presser rollers into said extended position.

6. A sheet-feeding device as recited in claim 5 and further comprising second cam means driven by said drive means and operative to cause said vane to be driven in said one direction, and resilient means for causing said vane to be driven in an opposite direction.

7. A sheet-feeding device as recited in claims 1, 2 or 4 and further comprising cam means driven by said drive means and operative to cyclically actuate said pump means and said presser means.

8. A sheet-feeding device as recited in claim 1 and further comprising exit roller means disposed to receive a sheet withdrawn from the stack by said feed means and to discharge the sheet from said device.

9. A sheet-feeding device as recited in claim 1 and further including means forming a plurality of air passageways extending between said inlet openings and said pump means, and gate means for allowing certain ones of said passageways to be selectively closed to accommodate different widths of sheet material.

10. A sheet-feeding device as recited in claim 9 wherein said pump means includes an arcuate chamber and a vane pivotally disposed therein such that when said vane is rotated in one direction about its pivot axis it causes air to be drawn through said inlet openings.

11. A sheet-feeding device as recited in claim 2 wherein said vane includes edge seals for continuously sealingly engaging the walls of said arcuate chamber during said rotational movement of said vane.

* * * * *